US008708042B2

(12) United States Patent
Kischkat et al.

(10) Patent No.: US 8,708,042 B2
(45) Date of Patent: Apr. 29, 2014

(54) APPARATUS AND METHOD FOR VALVE ACTUATION

(75) Inventors: Tobias Kischkat, Niedersachsen (DE); Eick Niemeyer, Niedersachsen (DE); Alexander Otto, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 489 days.

(21) Appl. No.: 13/026,465

(22) Filed: Feb. 14, 2011

(65) Prior Publication Data

US 2011/0198077 A1 Aug. 18, 2011

Related U.S. Application Data

(60) Provisional application No. 61/305,334, filed on Feb. 17, 2010.

(51) Int. Cl.
*E21B 49/10* (2006.01)
*E21B 49/08* (2006.01)

(52) U.S. Cl.
USPC ..... 166/264; 166/100; 73/152.24; 73/152.27; 73/152.28

(58) Field of Classification Search
USPC ..... 166/264, 100; 73/152.23–152.28
See application file for complete search history.

(56) References Cited

U.S. PATENT DOCUMENTS 5,473,939 A * 12/1995 Leder et al. ..... 73/152.12
5,622,223 A 4/1997 Vasquez
5,662,165 A 9/1997 Tubel et al.
5,868,201 A 2/1999 Bussear et al.
6,672,386 B2 1/2004 Krueger et al.
6,736,213 B2 5/2004 Bussear et al.
6,923,052 B2 8/2005 Krueger et al.
6,976,459 B2 12/2005 Kagy et al.
7,011,155 B2 3/2006 Meister et al.
7,100,695 B2 * 9/2006 Reitz ..... 166/372
7,266,983 B2 9/2007 Krueger et al.
7,395,703 B2 7/2008 Niemeyer et al.
7,503,389 B2 * 3/2009 Delaloye et al. ..... 166/304
7,503,398 B2 3/2009 Logiudice et al.
7,510,001 B2 3/2009 Spring et al.
7,601,950 B2 10/2009 Kischkat et al.
7,677,307 B2 3/2010 Vasques et al.
7,729,861 B2 6/2010 Niemeyer et al.
7,775,273 B2 8/2010 Merlau et al.
8,302,689 B2 * 11/2012 van Zuilekom et al. ..... 166/264
2004/0020649 A1 2/2004 Fields
2004/0154794 A1 * 8/2004 Appleford et al. ..... 166/267
2006/0054323 A1 3/2006 Grant et al.
2006/0117842 A1 6/2006 Ramakrishnan
2011/0206541 A1 * 8/2011 Yokozawa et al. ..... 417/271

FOREIGN PATENT DOCUMENTS

WO WO 2008045045 A1 * 4/2008 ..... E21B 49/10

* cited by examiner

*Primary Examiner* — Giovanna Wright
(74) *Attorney, Agent, or Firm* — Mossman, Kumar & Tyler PC

(57) ABSTRACT

An apparatus for controlling fluid flow that includes a chamber having a first valve and a second valve; a sensor that senses a pressure parameter associated with the chamber; and a controller programmed to operate the first valve and the second valve in response to the sensed pressure parameter may be used to control for flow and to obtain data relating to a formation and/or formation fluid.

18 Claims, 3 Drawing Sheets

APPARATUS AND METHOD FOR VALVE ACTUATION

FIELD OF THE DISCLOSURE

This application claims priority from U.S. Provisional Patent Application Ser. No.: 61/305,334, filed Feb. 17, 2010.

This disclosure pertains generally to investigations of underground formations and more particularly to systems and methods for formation testing and fluid sampling within a borehole.

BACKGROUND OF THE DISCLOSURE

To obtain hydrocarbons such as oil and gas, well boreholes are drilled by rotating a drill bit attached at a drill string end. Modern directional drilling systems generally employ a drill string having a bottomhole assembly (BHA) and a drill bit at an end thereof that is rotated by a drill motor (mud motor) and/or the drill string. A number of downhole devices placed in close proximity to the drill bit measure certain downhole operating parameters associated with the drill string. Such devices typically include sensors for measuring downhole temperature and pressure, azimuth and inclination measuring devices and a resistivity-measuring device to determine the presence of hydrocarbons and water. Additional downhole instruments, known as measurement-while-drilling (MWD) or logging-while-drilling (LWD) tools, are frequently attached to the drill string to determine formation geology and formation fluid conditions during the drilling operations. Commercial development of hydrocarbon fields requires significant amounts of capital. Before field development begins, operators desire to have as much data as possible in order to evaluate the reservoir for commercial viability. While data acquisition during drilling provides useful information, it is often also desirable to conduct further testing of the hydrocarbon reservoirs in order to obtain additional data. Therefore, after the well has been drilled, the hydrocarbon zones are often tested with other test equipment.

In one aspect, the present disclosure addresses the need to enhance control of devices used for acquiring data related to subsurface information.

SUMMARY OF THE DISCLOSURE

In aspects, the present disclosure provides devices and methods for controlling fluid flow and/or estimating one or more parameters of interest of a formation using direct or indirect pressure parameter measurements relating to a flow control device. The apparatus may include a chamber having a first valve and a second valve; a sensor that senses a pressure parameter associated with the chamber; and a controller programmed to operate the first valve and the second valve in response to the sensed pressure parameter.

In aspects, the present disclosure includes a method for controlling fluid flow. The method may include controlling a first valve and a second valve in fluid communication with a chamber by sensing a pressure parameter associated with the chamber. In aspects, the present method estimates one or more parameters of interest that include, but are not limited to, a volume of pumped fluid, a presence of a gas in the fluid, fluid compressibility, a pressure at a selected wellbore location, and a bubble point pressure.

In aspects, the present disclosure provides an apparatus for sampling a fluid from a subsurface formation. The apparatus may include a pump in fluid communication with the at least one sampling tank. The pump may include a chamber having a first valve and a second valve; a sensor configured to sense a pressure parameter associated with the chamber; and a controller programmed to operate the first valve and the second valve in response to the sensed pressure parameter; a sampling probe configured to contact a wellbore wall and being in fluid communication with the first valve; and at least one sampling tank in fluid communication with the second valve.

Examples of the more important features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

In aspects, the present disclosure relates to devices and method for providing enhanced control for flow control devices and for obtaining data relating to the formation and formation fluid. The teachings may be advantageously applied to a variety of systems both in the oil and gas industry and elsewhere. Merely for clarity, certain non-limiting embodiments will be discussed in the context of tools configured for wellbore uses.

Figure 1:
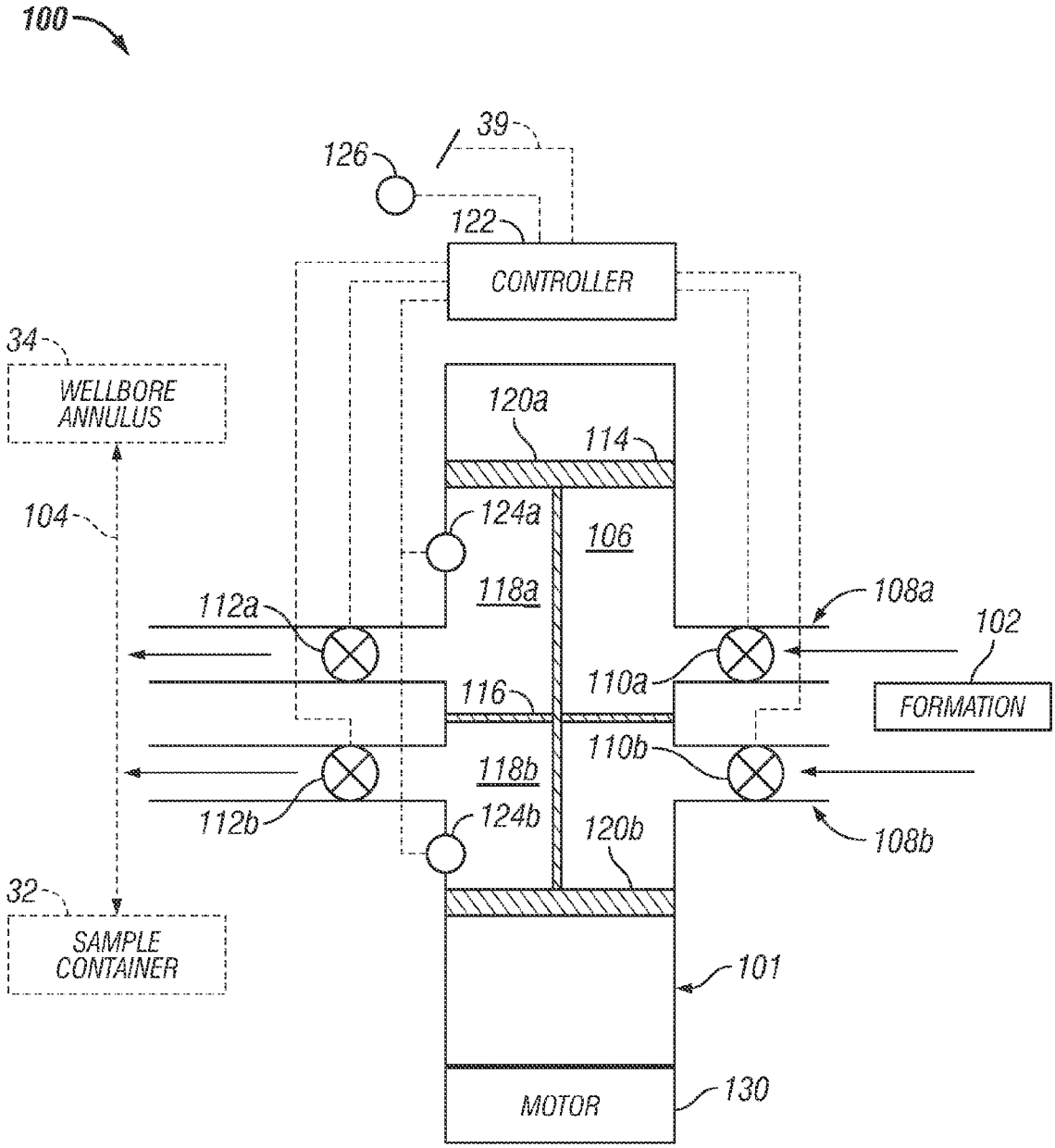
FIG. 1 shows a schematic of a downhole tool deployed in a wellbore along a wireline according to one embodiment of the present disclosure.

Referring initially to FIG. 1, there is schematically illustrated one embodiment of a system 100 that may be used to control flow between a first location 102 (e.g., a subsurface formation) and a second location 104 (e.g., a fluid sampling tank or a wellbore annulus). The system 100 may include a flow control device such as a pump 101 that may include a chamber 106 having one or more valve sets 108*a,b*. Each valve set 108*a,b* may include an inlet valve 110*a,b* and an outlet valve 112*a,b*. A piston 114 translates in the chamber 106 to displace fluid. FIG. 1 illustrates a dual action pumping arrangement wherein a wall 116 divides the chamber 106 into two hydraulically isolated sections 118*a,b*. Valve set 108*a* controls flow through section 118*a* and valve set 108*b* controls flow through section 118*b*. The piston 114 may include a head 120*a* disposed in section 118*a* and a head 120*b* disposed in section 118*b*. A controller 122 operates the valve sets 108*a,b* in coordination with the piston 114 movement to draw fluid from the first location 102 and expel the fluid to the second section 104. However, other embodiments may include a single action pumping arrangement; e.g., one chamber section, one piston head and one valve set.

In certain embodiments, the system 100 may operate the valve sets 108*a,b* by sensing a pressure parameter relating to the sections 118*a,b*. For instance, pressure sensors 124*a,b* may be positioned in pressure communication with each section 118*a,b*, respectively. Additionally or alternatively, as will be described later, an indirect estimate of a pressure in the sections 118*a,b* may also be used to operate the valve sets 108*a,b*. In one embodiment, the inlet valves 110*a,b* and/or outlet valves 112*a,b* are opened upon detecting one or more pre-determined condition(s). Illustrative pre-determined conditions include, but are not limited to, a pressure differential between the sections 118*a, b* and first location 102 or the second location 104 that is at or below a pre-set value. For instance, the controller 122 may be programmed to permit fluid flow into and/or out of the chamber 106 only when a pressure differential is below fifty PSI or substantially zero. It should be appreciated that minimizing the pressure differential prior to allow such fluid communication may reduce the likelihood of backflow of fluids and may reduce the pressure on seal elements and other components of the valve sets 108*a,b*.

Figure 2:
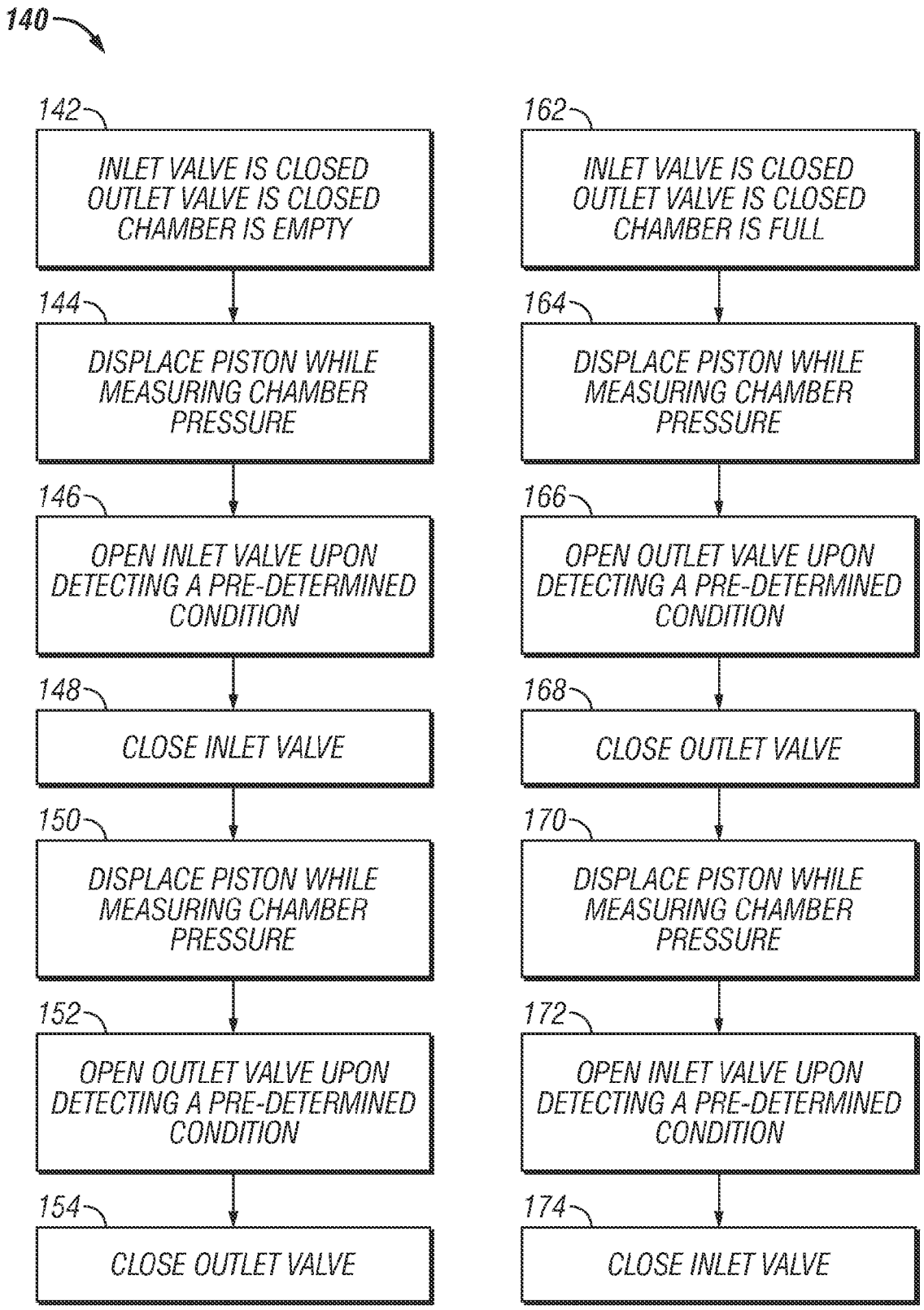
FIG. 2 shows a flow chart of an estimation method for one embodiment according to the present disclosure.

Referring now to FIG. 2, there is shown one illustrative method 140 for controlling fluid flow in the system 100 of FIG. 1 using directly or indirectly sensed pressure parameters relating to the chamber 106. Referring now to FIGS. 1 and 2, the method may be initiated at step 142 with the inlet valve 110*a* closed, the outlet valve 112*a* closed, and the section 118*a* substantially empty of fluid. In some applications, the pressure at the second location 104 may be greater than the pressure at the first location 102. This may result in a pressure in the section 118*a* being greater than the pressure at the first location 102. Additionally, at the initial step 142, the piston head 120*a* is positioned in the section 118*a* such that piston movement increases the volume in the section 118*a* and thereby reduces pressure.

At step 144, the piston head 120*a* is displaced to reduce pressure in the section 118*a*. Concurrently, the pressure sensor 124*a* senses the pressure in the section 118*a* and sends responsive signals to the controller 122. The controller 122 processes the sensor 124*a* signals and determines a pressure differential between the section 118*a* and the first location 102. The pressure at the first location 102 may pre-programmed into the controller 122. Alternatively or additionally, the pressure at the first location may be sensed using a suitable sensor, an illustrative sensor being labeled 126. For convenience, the pressure at the first location 102, which is external to the pump 101, may be referred to as the reference pressure.

At step 146, once the pre-determined pressure differential is reached between the pressure in the section 118*a* and the reference pressure, the controller 122 may actuate and open the inlet valve 110*a*. Fluid flows into the section 118*a* as the piston head 120*a* moves to further increase volume in the section 118*a*. At the completion of the stroke of the piston head 120*a*, the controller 122 may close the valve 110*a* at step 148.

At step 150, the piston head 120*a* is displaced to increase pressure in the section 118*a* by reducing the volume in the section 118*a*. Concurrently, the pressure sensor 124*a* senses the pressure in the section 118*a* and sends responsive signals to the controller 122. The controller 122 processes the sensor 124*a* signals and determines a pressure differential between the section 118*a* and the second location 104. The pressure at the second location 104 may pre-programmed into the controller 122. Alternatively or additionally, the pressure at the second location 104 may be sensed using a suitable sensor, e.g., the sensor 126. Now, the pressure at second location 104, which is also external to the pump 101, may be used as the reference pressure.

At step 152, once the pre-determined pressure differential is reached between the pressure in the section 118*a* and the reference pressure at the second location 104, the controller 122 may actuate and open the outlet valve 112*a*. Fluid flows out the section 118*a* as the piston head 120*a* moves to further decrease volume in the section 118*a*. At the completion of the stroke of the piston head 120*a*, the controller 122 may close the outlet valve 110*a* at step 154.

It should be appreciated that by sensing the pressure in the chamber 106 of the pump 101, pump operation may be controlled to minimize the pressure differentials existing at the time fluid flows into and out of the chamber 106. Reducing or minimizing these pressure differentials may reduce the likelihood that fluid flows in an undesirable direction (e.g., backflow) and that seals (not shown) and other components associated with the pump 101 do not encounter elevated pressures that impair operation.

While the FIG. 1 embodiment uses pressure sensors 124*a, b*, such as transducers, to directly sense pressure in the section 118*a*, indirect measurements of pressure may also be used. For example, the pump 101 may use a motor 130 to displace the piston 114. If the motor 130 is hydraulically driven, then the pressure of the hydraulic fluid used to energize the motor 130 may be monitored or sensed. That is, a relationship between applied hydraulic fluid pressure and the pressure in the section 118*a* may be developed, e.g., a computer model. The controller 122 may be programmed to use the model to indirectly estimate a pressure in the section 118*a* by sensing a pressure of the hydraulic fluid. In this instance, the hydraulic fluid pressure may be the sensed pressure parameter relating to the pump chamber 106 Likewise, if the motor 130 is electrically driven, the computer model may use a relationship between chamber 106 pressure and applied motor torque. In this instance, motor torque may be the sensed pressure parameter related to the chamber 106 pressure. Thus, generally speaking, embodiments of the present disclosure may use a sensed pressure parameter that directly or indirectly provide an estimate of a pressure in the chamber 106.

Additionally, the method 140 may be applied to both single action and dual action pumps. For instance, for dual action pumps, steps 162 to 174 may be used in a synchronous fashion with steps 142 to 154.

At step 162 the inlet valve 110*b* is closed, the outlet valve 112*b* is closed, and the section 118*b* is substantially filled with fluid. Additionally, at the step 162, the piston head 120*b* is positioned in the section 118*b* such that piston movement decreases the volume in the section 118*b* and thereby increases pressure.

At step 164, the piston head 120*b* is displaced to increase pressure in the section 118*b*. Concurrently, the pressure sensor 124*b* senses the pressure in the section 118*b* and sends responsive signals to the controller 122. The controller 122 processes the sensor 124*b* signals and determines a pressure differential between the section 118*b* and the second location 104. The pressure at the second location may pre-programmed into the controller 122. Alternatively or additionally, the pressure at the second location 104 may be sensed using a suitable sensor, e.g., sensor 126. In any case, the sensed pressure acts as the reference pressure.

In one arrangement, at step 166, once the pre-determined pressure differential is reached between the pressure in the section 118*b* and the reference pressure, the controller 122 may actuate and open the outlet valve 112*b*. Fluid flows out of the section 118*b* as the piston head 120*b* moves to further decrease volume in the section 118*b*. At the completion of the stroke of the piston head 120*b*, the controller 122 may close the outlet valve 110*b* at step 168. In another arrangement, the controller 122 may be programmed to receive pressure data from section 118*a* and section 118*b*. In such an arrangement, the controller 122 may be programmed to open the inlet valve

110*a* and the outlet valve 112*b* upon either section 118*a* or 118*b* reaching the desired pressure differential.

At step 170, the piston head 120*b* is displaced to decrease pressure in the section 118*b* by increasing the volume in the section 118*b*. Concurrently, the pressure sensor 124*b* senses the pressure in the section 118*b* and sends responsive signals to the controller 122. The controller 122 processes the sensor 124*b* signals and determines a pressure differential between the section 118*b* and the first location 102. The pressure at the first location 102 may pre-programmed into the processor 122. Alternatively or additionally, the pressure at the second location 104 may be sensed using a suitable sensor.

At step 172, once the pre-determined pressure differential is reached, the controller 122 may actuate and open the inlet valve 112*b*. Fluid flows into the section 118*b* as the piston head 120*b* moves to further increase volume in the section 118*b*. At the completion of the stroke of the piston head 120*b*, the controller 122 may close the inlet valve 110*b* at step 174. In another arrangement, the controller 122 may be programmed to close the inlet valve 110*b* and the outlet valve 112*a* upon either section 118*a* or 118*b* reaching the desired pressure differential.

Thus, it should be appreciated that the valve sets 108*a,b* may be operated in a synchronized fashion wherein the controller 122 operates the valves sets 108*a,b* using pressure parameter data that directly or indirectly provides an estimate of a pressure in the pump 101, e.g., in the pump chamber 106.

In a variant of method 140, the pump 101 may be operated in reverse in order to apply fluid pressure to the formation rather than to draw fluid from the formation. That is, for example, the pressure in the chamber 106 is increased prior to opening the inlet valve 110*a* to insure that fluid flows from the chamber 106 to the formation via the inlet valve 110*a*. Such an operation may be used to estimate a formation fracture pressure. For example, the pressure in the chamber 106 may be monitored as fluid is ejected through the inlet valve 110*a*. The pressure will generally increase until the pressure value exceeds the formation fracture pressure. Once the formation fractures, fluids escapes into the fissures in the borehole wall, which results in a relatively pronounced drop in pressure. The pressure sensor 118*a* may be used to identify the pressure at which the fracture occurs. Thus, it should be appreciated that the terms "inlet" and "outlet" are used merely for ease of discussion and do not imply that the valves or the pump are configured to convey fluid in only one direction.

Additionally, it should be understood that the devices, systems and methods of the present disclosure may also be used to estimate parameters of interest relating to wellbore equipment, the wellbore and the surrounding information. Illustrative method for estimating such parameters of interest using pressure parameters relating to the pump 101 are discussed below.

In one method for enhanced estimates of the volume of fluid being pumped to the second location 104 (e.g., a sample container 32 of FIG. 3), pumped volume-related data is collected only when either inlet valve or the outlet valve is open. This data may then be processed to estimate a volume of fluid pumped by the pump. For example, piston movement may be associated with volume of fluid pumped. That is, a specified amount of piston movement may be correlated to a specified volume of fluid. The controller 122 may be programmed to use piston movement data only when either the inlet valve or the outlet valve is open to estimate the volume of fluid pumped. By not using piston movement data when both valves are closed, the effect of fluid compressibility may be reduced or eliminated from the volume estimation. Such correlations may also take into account other factors such as pressure, temperature, prior test data, etc.

In an exemplary method for enhanced estimates of fluid properties or composition, a suitable sensor may sense a parameter indicative of piston movement when the inlet valve and the outlet valve are closed. This data may then be analyzed to estimate a parameter of interest relating to the fluid, such as fluid compressibility and/or a presence of a gas in the fluid.

In an exemplary method for estimating bubble point for the formation fluid, fluid may be trapped in the chamber 106 by closing the inlet valve 110*a* and the outlet valve 112*a*. Thereafter, pressure is reduced in the chamber 106. The bubble point pressure of the fluid may be estimated using a pressure sensor 124*a* associated with the chamber 106 to identify the pressure at which gas bubble form. The pressure in the chamber 106 may also be sensed indirectly.

In still other modes of operation, the sensors 124*a,b* may be used to sense pressure at locations other than the chamber 106. For example, by opening the outlet valve 112*a*, the sensor 124*a* may sense the pressure in the fluid sample tank 32 (FIG. 3) or the wellbore annulus. Also, by opening the inlet valve 110*a*, the sensor 124*a* may sense the pressure in the formation.

Figure 3:
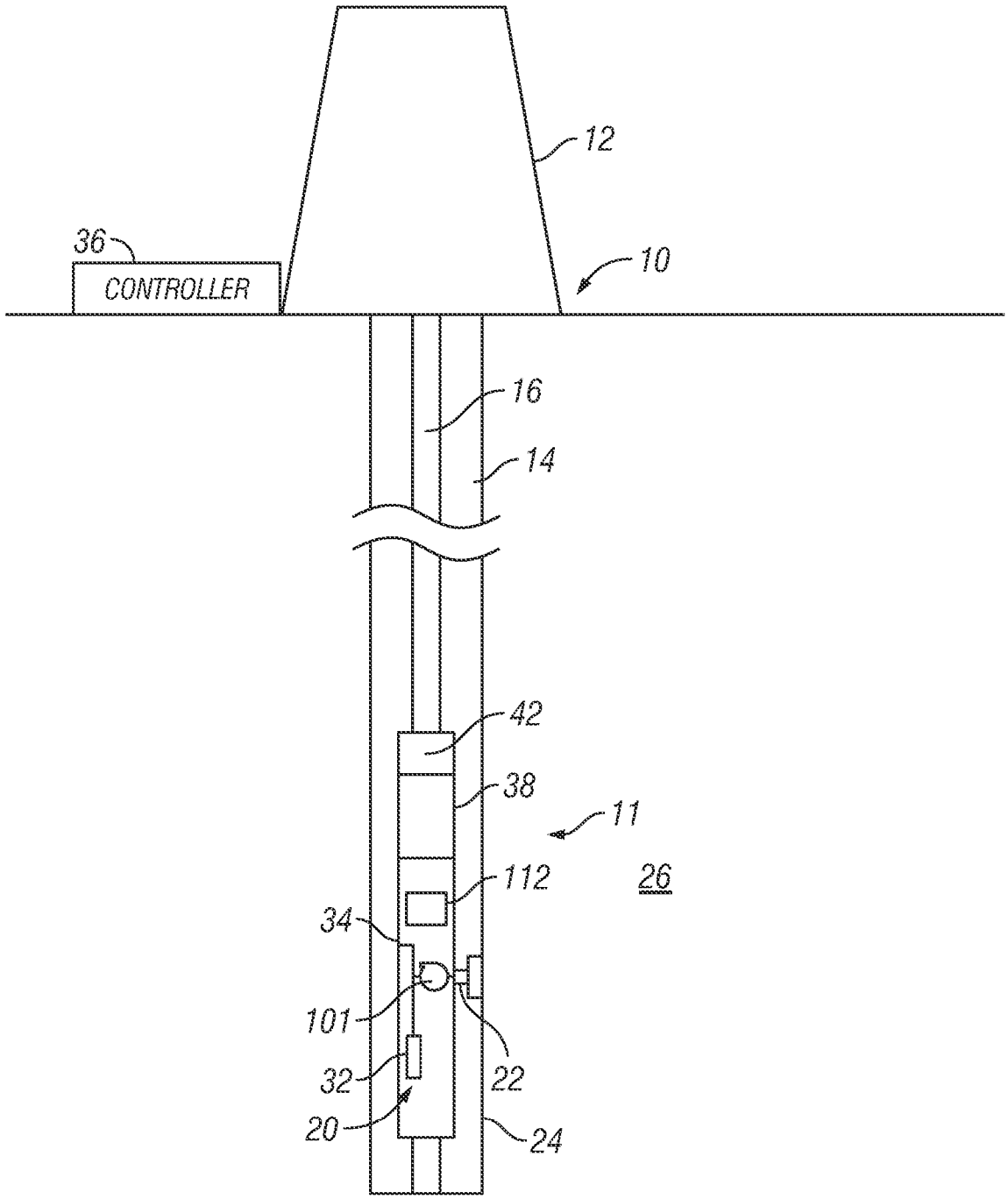
FIG. 3 shows schematic of the apparatus for implementing one embodiment of the method according to the present disclosure.

Such correlations may also take into account other factors such as pressure, temperature, prior test data, etc. As should be appreciated, the teachings of the present disclosure may be applied to a variety of situations, some of which involve the evaluation of subterranean formation. FIG. 3 illustrates one non-limiting embodiment of wellbore systems that may use aspects of the present disclosure.

FIG. 3 is a schematically illustrates a wellbore system 10 deployed from a rig 12 into a borehole 14. While a land-based rig 12 is shown, it should be understood that the present disclosure may be applicable to offshore rigs and subsea formations. The wellbore system 10 may include a carrier 16 and a fluid analysis tool 20. The fluid analysis tool 20 may include a probe 22 that contacts a borehole wall 24 for extracting formation fluid from a formation 26. Wellbore fluid can be drawn from the borehole 14 also by not extending the probe 22 to the wall and pumping fluid from the borehole 14 instead of the formation 26. The fluid analysis tool 20 may include a pump 101 that pumps formation fluid from formation 26 via the probe 22. Formation fluid travels along a flow line to one or more sample containers 32 or to line 34 where the formation fluid exits to the borehole 14. Alternatively, the pump 101 may be operated to apply fluid pressure to the borehole wall 24.

In some embodiments, the wellbore system 10 may be a drilling system configured to form the borehole 14 using tools such as a drill bit (not shown) and may also be equipped with a survey tool 11. In such embodiments, the carrier 16 may be a coiled tube, casing, liners, drill pipe, etc. In other embodiments, the wellbore system 10 may convey the survey tool 11 with a non-rigid carrier. In such arrangements, the carrier 16 may be wirelines, wireline sondes, slickline sondes, e-lines, etc. The term "carrier" as used herein means any device, device component, combination of devices, media and/or member that may be used to convey, house, support or otherwise facilitate the use of another device, device component, combination of devices, media and/or member. The data collected by the survey tool 11 may be processed by a surface controller 36 as in this example or by using a downhole controller 122 to determine the desired parameter. The controller 122 may be an information processor that is data communication with a data storage medium and a processor memory. The surface controller 36 and the downhole controller 122 may communicate via a communication link, such as a data conductor 39. The data storage medium may be any standard computer data storage device, such as a USB drive, memory stick, hard disk, removable RAM, EPROMs, EAROMs, flash memories and optical disks or other commonly used memory storage system known to one of ordinary skill in the art including Internet based storage. The data storage medium may store one or more programs that when executed causes information processor to execute the disclosed method(s). Signals indicative of the parameter may be transmitted to a surface controller 36 via a transmitter 42. The transmitter 42 may be located in the BHA or at another location on the carrier 16 (e.g., drill string). These signals may also, or in the alternative, be stored downhole in a data storage device and may also be processed and used downhole for geosteering or for any other suitable downhole purpose. In one example, wired pipe may be used for transmitting information.

During one exemplary use, the survey tool 11 is positioned adjacent a formation of interest and the probe 22 is pressed into sealing engagement with the borehole wall 24. Using the method of FIG. 2 to operate the pump 101, the pressure in the probe 22 is lowered below the pressure of the formation fluids so that the formation fluids flow through the probe 22 into the tool 20. As indicated previously, the pump 101 may be a single action pump, a dual action pump, or some other configuration. During pumping, it should be appreciated that the flow from the formation to the chamber 106 (FIG. 1) is permitted generally only when the chamber pressure is lower than the formation fluid pressure, and the flow out of the chamber 106 (FIG. 1) is permitted generally only when the chamber pressure is greater than the pressure in a sample container 32 or the borehole annulus 34. Thus, counter flow or back flow at the opening of the valves 110*a, b*, 112*a,b* is minimized during pump operation. Additionally, the minimal pressure differentials reduce the pressure applied to the various components of the pump 101, such as the seals, when the valves 110*a, b*, 112*a,b* are opened. As described previously, the controller 122 may control the opening and closing of the valves 110*a,* b, 112*a,b* using the pressure in the chamber 106, which may be sensed directly or indirectly.

During another exemplary use, the survey tool 11 is positioned adjacent to a formation of interest and the probe 22 is pressed into sealing engagement with the borehole wall 24. The pump 101 may be operated to increase the pressure in the probe 22. As the pressure in the probe 22 is increased to apply pressure to the borehole wall 24, the sensor or sensors 124*a,b* sense the pressure of the fluid in contact with the borehole wall 24. Alternatively or additionally, the pressure may be sensed indirectly as previously discussed. The fracture pressure of the formation may be estimated from processing the data relating to the sensed pressure.

In yet other uses, the pump 101 and the pressure parameter data obtained by the sensors associated with the pump 101 may be used to estimate parameters of interest relating to wellbore equipment, the wellbore and the surrounding information such as fluid compressibility and/or a presence of a gas in the fluid, the bubble point pressure of the fluid.

Moreover, while fluid analysis tools have been discussed, it should be appreciated that the teachings of the present disclosure may be used in any number of tools that control or direct flow. Thus, for instance, the teachings of the present disclosure may be used to enhance the operation of valves in drilling motors, steering device, thrusters, active stabilizers, intelligent completion devices, etc.

Thus, it should be appreciated that what has been described includes, in part, an apparatus for controlling fluid flow that may include a chamber having a first valve and a second valve; a sensor that senses a pressure parameter associated with the chamber; and a controller programmed to operate the first valve and the second valve in response to the sensed pressure parameter. The controller may be programmed to use a reference pressure value to operate the first valve, and/or the second valve. The reference pressure value may be a pressure of a fluid in a formation, a pressure of a fluid in a wellbore, and/or a pressure in a sample container. Also, the controller may be programmed to compare the sensed pressure parameter with the reference pressure value. The controller may be programmed to use an estimated difference between the sensed pressure parameter and the reference pressure value to operate the first valve, and/or a second valve. The first valve may be configured to control fluid flow between a subsurface formation and the chamber. The second valve may be configured to control fluid flow between the chamber and a wellbore, and/or a container.

It should also be appreciated that what has been described includes, in part, a method for controlling fluid flow. The method may include controlling a first valve and a second valve in fluid communication with a chamber by sensing a pressure parameter associated with the chamber. The method may include using reference pressure value to operate the first valve, and/or the second valve. The reference pressure value may be a pressure of a fluid in a formation, or a pressure of a fluid in a wellbore. The method may also include comparing the sensed pressure parameter with the reference pressure value to operate the first valve and/or the second valve and/or estimating a difference between the sensed pressure parameter and the reference pressure value to operate the first valve, and/or the second valve. The method may further include controlling fluid flow between a subsurface formation and the chamber using the first valve. Controlling the fluid flow may be done using the second valve that is positioned between the chamber and one of: (a) a wellbore, and (b) a container.

The method may be used in an arrangement wherein the chamber is formed in a pump. In such arrangements, the method may include estimating a parameter of interest relating to the pump only when the first valve or the second valve are open; and estimating a volume of pumped fluid using the estimated parameter of interest. In arrangements where the chamber is formed in a pump and a piston is disposed in the chamber, the method may include sensing piston movement when the first valve and the second valve are closed; and estimating a parameter of interest relating to the fluid in the chamber using the sensed piston movement. The estimated parameter of interest may be one of: (i) a presence of a gas in the fluid, and (ii) fluid compressibility. In embodiments, the method may include opening the second valve; and estimating a pressure at a selected wellbore location using a sensor associated with the chamber, wherein the selected wellbore location may be an annulus, and/or a sample container. The method may also include closing the first valve and the second valve; reducing a pressure in the chamber; and estimating a bubble point pressure using a sensor associated with the chamber.

It should further be appreciated that what has been described includes, in part, an apparatus for sampling a fluid from a subsurface formation. The apparatus may include a pump in fluid communication with the at least one sampling tank. The pump may include a chamber having a first valve and a second valve; a sensor configured to sense a pressure parameter associated with the chamber; and a controller programmed to operate the first valve and the second valve in response to the sensed pressure parameter; a sampling probe configured to contact a wellbore wall and being in fluid communication with the first valve; and at least one sampling tank in fluid communication with the second valve. The sensor may be configured to sense a pressure in the chamber and/or a motor associated with the motor.

While the foregoing disclosure is directed to the one mode embodiments of the disclosure, various modifications will be apparent to those skilled in the art. It is intended that all variations be embraced by the foregoing disclosure.

We claim:

1. An apparatus for controlling fluid flow in a wellbore, comprising:

a pump configured to be disposed in the wellbore, the pump having:

a chamber having a first valve and a second valve;

a sensor configured to sense a pressure parameter associated with the chamber; and a controller programmed to operate the first valve and the second valve by estimating a pressure differential using the sensed pressure parameter, wherein the controller is programmed to use a reference pressure value to operable at least one of: (i) the first valve, and (ii) the second valve, and wherein the reference pressure relates to one of: (i) a fluid in the formation, (ii) a fluid in the wellbore; and (iii) a fluid in a sample container.

2. The apparatus according to claim 1, wherein the controller is programmed to compare the sensed pressure parameter with the reference pressure value.

3. The apparatus according to claim 1, wherein the pressure differential is estimated using the sensed pressure parameter and thereference pressure value.

4. The apparatus according to claim 1, wherein the first valve is configured to control fluid flow between a subsurface formation and the chamber.

5. The apparatus according to claim 1, wherein the second valve is configured to control fluid flow between the chamber and one of: (a) the wellbore, and (b) a container.

6. A method for controlling fluid flow, comprising:

positioning a pump in a wellbore, the pump having a first valve, a second valve, and a chamber controlling the first valve and the second valve in fluid communication with the chamber by sensing a pressure parameter associated with the chamber and estimating a pressure differential using the sensed pressure parameter, and controlling fluid flow between a subsurface formation and the chamber using the first valve.

7. The method according to claim 6, further comprising using a reference pressure value to operate at least one of: (i) the first valve, and (ii) the second valve.

8. The method according to claim 7, wherein the reference pressure value is one of: (i) a pressure of a fluid in a formation, and (ii) a pressure of a fluid in a wellbore.

9. The method according to claim 7, further comprising comparing the sensed pressure parameter with the reference pressure value to operate one of: (i) the first valve, and (ii) the second valve.

10. The method according to claim 7, further comprising estimating a difference between the sensed pressure parameter and the reference pressure value to operate at least one of: (i) the first valve, and (ii) a second valve.

11. The method according to claim 6, further comprising:

estimating a parameter of interest relating to the pump only when at least one of (i) the first valve and, (ii) the second valve are open; and estimating a volume of pumped fluid using the estimated parameter of interest.

12. The method according to claim 6, wherein a piston is disposed in the chamber, and further comprising:

sensing piston movement when the first valve and the second valve are closed;

estimating a parameter of interest relating to the fluid in the chamber using the sensed piston movement.

13. The method according to claim 12 wherein the estimated parameter of interest is one of: (i) a presence of a gas in the fluid, and (ii) fluid compressibility.

14. The method according to claim 6, further comprising:

opening the second valve; and estimating a pressure at a selected wellbore location using a sensor associated with the chamber, wherein the selected wellbore location is one of: (i) an annulus, and (ii) a sample container.

15. The method according to claim 6, further comprising:

closing the first valve and the second valve;

reducing a pressure in the chamber; and estimating a bubble point pressure using a sensor associated with the chamber.

16. A method for controlling fluid flow, comprising:

positioning a pump in a wellbore, the pump having a first valve and a second valve in communication with a chamber;

controlling the first valve and the second valve by sensing a pressure parameter associated with the chamber and estimating a pressure differential using the sensed pressure parameter; and controlling fluid flow by using the second valve positioned between the chamber and one of: (a) a wellbore, and (b) a container.

17. An apparatus for sampling a fluid from a subsurface formation, comprising:

a pump in fluid communication with the at least one sampling tank, the pump including:

a chamber having a first valve and a second valve;

a sensor configured to sense a pressure parameter associated with the chamber; and a controller programmed to operate the first valve and the second valve by estimating a pressure differential using the sensed pressure parameter;

a sampling probe configured to contact a wellbore wall and being in fluid communication with the first valve; wherein the at least one sampling tank is in fluid communication with the second valve.

18. The apparatus according to claim 17, wherein the sensor is configured to sense: (i) a pressure in the chamber, (ii) a motor associated with the motor operatively connected to the pump.

* * * * *